US006056230A

United States Patent [19]

Peters et al.

[11] Patent Number: 6,056,230

[45] **Date of Patent: *May 2, 2000**

[54] ROLLER FOR A WINDING MACHINE

[75] Inventors: Hans-Friedrich Peters, Ratingen; Georg Müller, Neuss, both of Germany

[73] Assignee: Jagenberg Papiertechnik GmbH, Neuss, Germany

[ * ] Notice: This patent is subject to a terminal disclaimer.

[21] Appl. No.: 09/101,337

[22] PCT Filed: Jan. 15, 1997

[86] PCT No.: PCT/EP97/00146

§ 371 Date: Jul. 2, 1998

§ 102(e) Date: Jul. 2, 1998

[87] PCT Pub. No.: WO97/28075

PCT Pub. Date: Aug. 7, 1997

[30] Foreign Application Priority Data

| | | | |
|---|---|---|---|
| Jan. 30, 1996 | [DE] | Germany | 196 03 211 |
| Sep. 4, 1996 | [DE] | Germany | 296 15 385 U |

[51] Int. Cl.[7] ..... B65H 18/14

[52] U.S. Cl. ..... 242/541.5; 242/542.4; 242/547

[58] Field of Search ..... 242/542.4, 547, 242/541.5, 541.6; 492/56

[56] References Cited

U.S. PATENT DOCUMENTS

| | | | |
|---|---|---|---|
| 2,985,398 | 5/1961 | Rockstrom . | |
| 3,240,442 | 3/1966 | Kilmartin . | |
| 3,503,567 | 3/1970 | Casey . | |
| 3,565,746 | 2/1971 | Stevens . | |
| 3,702,687 | 11/1972 | Hall . | |
| 3,972,135 | 8/1976 | Pietraszek . | |
| 4,026,487 | 5/1977 | Ales | 242/542.4 |
| 4,193,559 | 3/1980 | Ballard . | |
| 5,101,930 | 4/1992 | Fargo . | |
| 5,553,806 | 9/1996 | Lucas | 242/542.4 |
| 5,582,361 | 12/1996 | Muller et al. | 242/542.4 |
| 5,758,842 | 6/1998 | Dorfel et al. | 242/547 |
| 5,785,273 | 7/1998 | Wolf et al. | 242/542.4 |
| 5,803,398 | 9/1998 | May et al. | 242/547 |
| 5,853,139 | 12/1998 | Hehner et al. | 242/541.6 |

FOREIGN PATENT DOCUMENTS

| | | |
|---|---|---|
| 0 157 062 | 10/1985 | European Pat. Off. . |
| 0 274 096 | 7/1988 | European Pat. Off. . |
| 0 562 266 A1 | 9/1993 | European Pat. Off. . |
| 0 683 125 A1 | 11/1995 | European Pat. Off. . |
| 2 153 871 | 5/1973 | France . |
| 829 831 | 1/1952 | Germany . |
| 6604059 | 8/1968 | Germany . |
| 2 215 342 | 10/1973 | Germany . |
| 74 15946 | 5/1974 | Germany . |
| 78 01 417 | 1/1978 | Germany . |
| 92 04 175 U | 8/1992 | Germany . |
| 94 20 003 U | 6/1995 | Germany . |
| 44 14 396 A1 | 11/1995 | Germany . |
| 195 05 870 A1 | 8/1996 | Germany . |
| WO 92/07784 | 5/1992 | WIPO . |

OTHER PUBLICATIONS

"Kunststofftabellen für Typen Eigenschaften Halbzeugabmessungen" published Apr. 1973 by Schiffmannn Tabellen Verlag.

*Primary Examiner*—John M. Jillions
*Attorney, Agent, or Firm*—Herbert Dubno

[57] ABSTRACT

Webs of paper or cardboard are rolled up using carrying or supporting rollers or pressing rollers with a hollow cylindrical body of a rigid material to which a deformable layer is applied. The deformable layer consists of a cellular plastic material partly with open pores and partly with pores which are closed on themselves and in which the pore size can be less than 5 mm. The compression modulus of the material is less than 10 MPa.

19 Claims, 2 Drawing Sheets

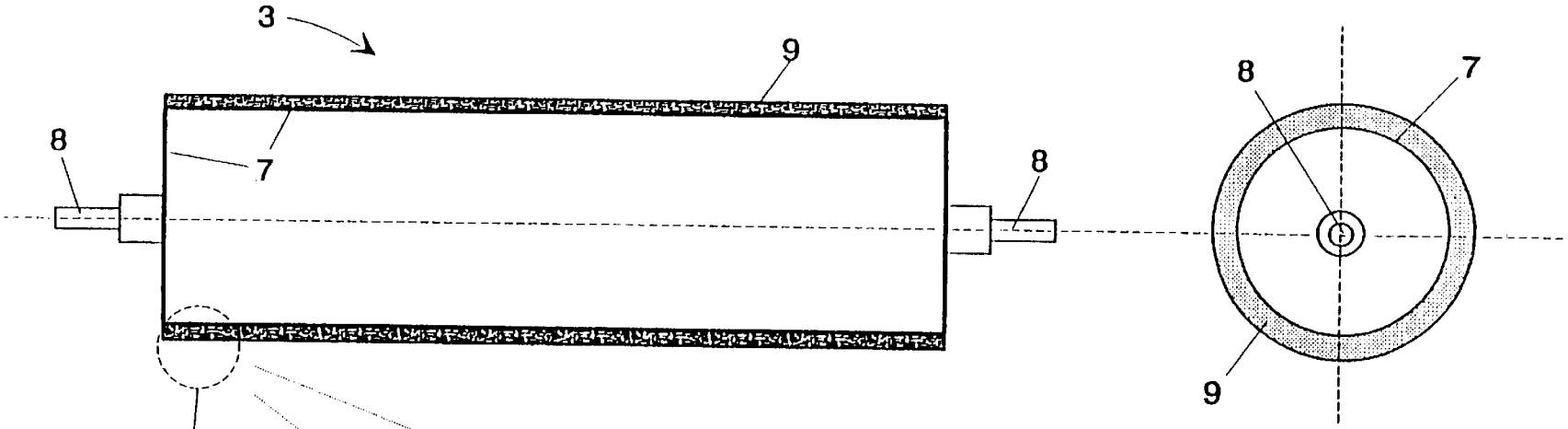
Fig. 2
Fig. 1
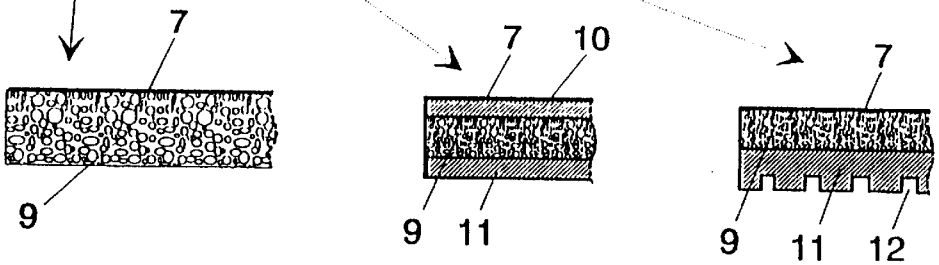
Fig. 5
Fig 4
Fig. 3

ROLLER FOR A WINDING MACHINE

CROSS REFERENCE TO RELATED APPLICATIONS

This application is a national stage of PCT/EP97/00146, filed Jan. 15, 1997 and based on German National Application 196 032 11.3 of Jan. 30, 1996 and 296 15 385.0 of Sep. 4, 1996 under the International Convention.

TECHNICAL FIELD

The invention relates to a roller for a winding machine, particularly for winding paper or cardboard webs, whose purpose it is to be pressed against the winding rolls during winding and to a winding machine provided with a roller according to the invention.

STATE OF THE ART

In order to produce wound-up rolls from longitudinally subdivided paper or cardboard webs, it is known to use winding machines with one or two driven rollers against which the winding rolls rest or on which they are supported. The rollers are known as support rollers when they bear the full weight of the supported winding roll (DE-A 39 24 612). When the weight is totally or only partially supported by guide heads inserted in the sleeves of the winding roll and held on support arms, then the roller is defined as a backing roller (DE-C 31 02 894, DE-C 40 12 979).

Furthermore winding machines comprise a so-called pressure roller, which at the onset of winding is pressed in opposite direction to the contact line between the winding roll and a support or backing roller, when the contact pressure resulting from the weight of the roll is not yet sufficient to obtain the desired winding firmness and which contributes considerably to the stability of the winding operation (DE-C 37 19 093, EP-C0410093).

The winding firmness which is decisive for the quality of the wound rolls (surface compression between the layers of a wound roll) depends on the line load and the geometric conditions in the nip between the winding roll and the support or backing roller. The term "line load" means the contact pressure scaled to the width of the winding roll and measured in N/m. In the production of wound rolls all efforts are aimed at setting a predetermined, uniform winding firmness at high speeds, without surface damage or winding defects occurring in the wound roll. Winding defects are caused by excessive stretching of the web in the nip. Since the stretching in the nip between the support roller and a winding roll increases with the increasing diameter of the roll, its value limits the maximal final diameter of a wound roll free of winding defects.

In order to produce good-quality wound rolls with a larger diameter, the EP-A-0562266 proposes a winding machine with support rollers whose support roller on the outgoing side, which is not wrapped by the web and is lower with respect to the support lower roller on the incoming side, is provided with shell which is considerably more deformable than the shell of the support roller on the incoming side. According to one embodiment the support roller has an outer layer of rubber, wherein chambers connected to the steel interior of the support body are provided. Due to the strong deformability, the contact pressure on the support roller should be as limited as possible, so that the winding hardness does not increase disproportionally.

OBJECT OF THE INVENTION

It is the object of the invention to create a roller for a winding machine, which when used as a support or backing roller will make possible a winding with a lower winding hardness. When used as a pressure roller, it should be capable to compensate the variations in the uniformity of the winding rolls, e.g. the ones resulting from the web profile variations, and to insure this way the uniformity of the contact pressure.

This object is achieved, in accordance with the invention in a roller for a winding machine for winding paper or cardboard webs into rolls and which comprises a hollow cylindrical support body made of a rigid material and a deformable layer on a peripheral surface of the body. The deformable layer consists of a cellular plastic material with a multitude of uniformly distributed pores and of a compression modulus k of less than 10 MPa.

BRIEF DESCRIPTION OF THE DRAWING

The above and other objects, features, and advantages will become more readily apparent from the following description, reference being made to the accompanying drawing in which:

FIG. 1 is a longitudinal section through a support of the backing roller of the invention;

FIG. 2 is a cross section through the roller of FIG. 1,

FIGS. 3 to 5 are enlarged sections of various configurations of the outer shell layer of the roller;

WAY TO IMPLEMENT THE INVENTION

Figure 8:
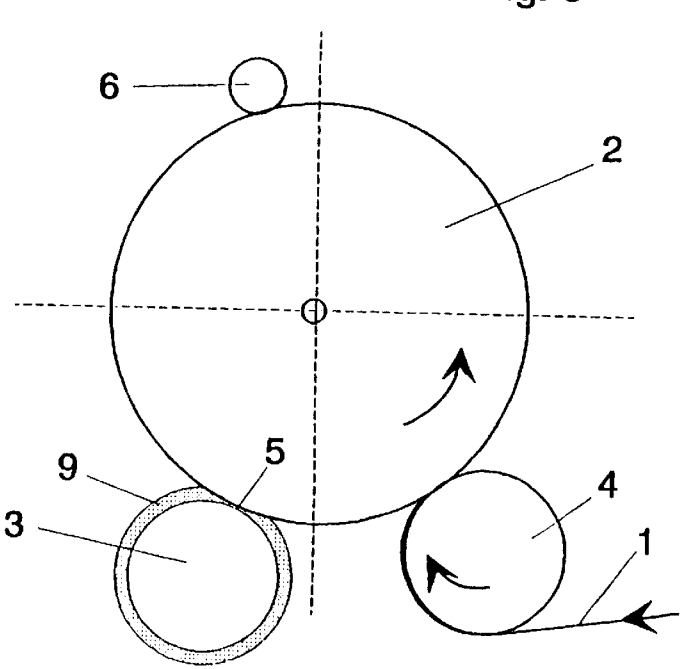
FIGS. 7 and 8 are diagrams of the way a support roller of the invention works within a winding machine with support rollers, in comparison to a support roller according to the state of the art.

FIG. 8 illustrates the principle of a winding machine with support rollers for producing wound rolls 2 from longitudinally subdivided paper or cardboard webs 1, wherein the roller shown in FIGS. 1 to 6 is used as a support roller or as a pressure roller. A winding machine with support rollers comprises two driven support rollers 3, 4 on which during winding the winding rolls 2 are supported coaxially and aligned and which therefore bear the entire weight of the winding rolls. Preferably the paper or cardboard web 1 is guided from below through the gap between the support rollers 3, 4 partially wrapping the support roller 4 on the incoming side and feeding into the nip between the support roller 4 on the incoming side and the winding roll 2 resting on the latter.

One or both support rollers 3, 4 of the winding machine with support rollers are equipped as the rollers of the invention. Preferably the roller according to the invention is used as a support roller 3 on the outgoing side, which with respect to the support roller 4 on the incoming side is arranged so that its contact line to the winding roll (nip 5) is at the same level or lower than the contact line between the other support roller 4 and the winding roll. In this way the support roller 3 bears the same or a greater portion of the weight of the winding roll 2. In addition it is also possible to equip the support roller 4 on the incoming side as a roller according to the invention.

On top of the winding rolls 2 rests a pressure roller 6 extending over the entire work width of the winding machine, i.e. the axial length of the support rollers 3, 4, which at the onset of the winding process presses the winding rolls 2 against the support roller 3, 4, when the weight of the winding rolls is not yet sufficient for the desired winding hardness.

In FIGS. 1 to 6 the construction of the roller according to the invention used either as a support or a backing roller is described in detail. As a support or backing roller 3 it has an axial length which corresponds to the maximal width of the paper or cardboard web 1 to be processed, which can amount up to 10 m. Its diameter ranges between 500 mm and 1500 mm. The support or backing roller of the invention consists of a hollow cylindrical support body 7 made of a rigid material, particularly steel, with a sufficiently stable design, so that it can withstand the forces acting upon the winding rolls 2 supported thereon or resting thereagainst and prevent them from bending. On both ends of the support body 7 pivots 8 are provided, by means of which the roller 3 is mounted in the frame of the winding machine. One of the pivots 8 of each support or backing roller 3 is connected to a rotary drive, by means of which the roller 3 is turned about its longitudinal axis, in order to rotate the winding rolls 2 for the purpose of winding.

On the outer peripheral surface of the support body 7 a layer 9 is applied, made of a cellular plastic material, with a multitude of pores filled with a gas, particularly air, which makes it compressible and which has a compression module k of less than 10 MPa. It is important that a great number of relatively small pores be evenly distributed over the volume of the layer 9. Preferably the pore size is less than 5 mm, a pore size between 0.05 mm and 1 mm has proven to be advantageous. Preferably the pores in the layer 9 are partially open—which means that they are interconnected—, and partially they are closed. The proportion of the open pores amounts to 30% to 70%, preferably approximately 50%. The ratio between the open pores and the closed pores determines the compressibility, as well as the capability of the layer to carry off the heat produced within it, in order to avoid undesirable overheating.

Advantageously for the layer 9 a cellular elastomer produced by foaming, particularly polyurethane is used, with a compression module k of 1 MPa to 5 MPa. The radially measured thickness of the layer 9 amounts to at least 10 mm, preferably between 10 mm and 40 mm, in the example approximately 25 mm. The density of the material of layer 9 with the pores amounts to less than 800 kg/m$^3$, preferably between 350 to 650 kg/m$^3$. According to a preferred embodiment the layer 9 has a hardness ranging between 15 and 60 Shore-A. Therefore the roller is relatively soft on its outer surface, in order to form a wider nip at contact with a winding roll.

FIGS. 3 to 5 show various possibilities of mounting the compressible layer 9 on the support body 7.

In the embodiment of FIG. 3 the peripheral surface of the support body 7 is provided exclusively with a layer 9 of compressible material, preferably a cellular elastomer. The thickness of the layer 9 ranges between 10 mm and 40 mm.

A multitude of circular and spaced apart grooves not shown in FIG. 3 are worked into the outer surface of the layer 9, in order to avoid the winding in of air into a winding roll 2 or to reduce an excessive noise development during winding.

In the embodiment according to FIG. 4, between the compressible layer 9 and the support body 7, a hard ground layer 10 is provided, made of incompressible material, preferably rubber, which is skidlessly connected with the support body 7. The nonskid connection can be achieved for instance through vulcanization. In order to form a wear-resistant outer tread surface 11, on the outside of the compressible layer 9 a further elastic layer is provided, which can be grooved, if required.

FIG. 5 shows an embodiment with surrounding grooves 12 in a wear-resistant outer layer 11. The compressible layer 9 is directly fastened to the support body 7 without an intermediate layer.

In the embodiments according to FIGS. 4 and 5 with an additional elastic but incompressible layer 11 it is important that its construction and characteristics are selected so that, as a purely protective layer it does not seriously influence the deformability, especially the compressibility of the peripheral surface of the support or backing roller 3 under the weight of a winding roll 2. In order to diminish its influence on the deformability, the outer tread surface 11 can be weakened by cuts running across the grooves 12.

Figure 6:
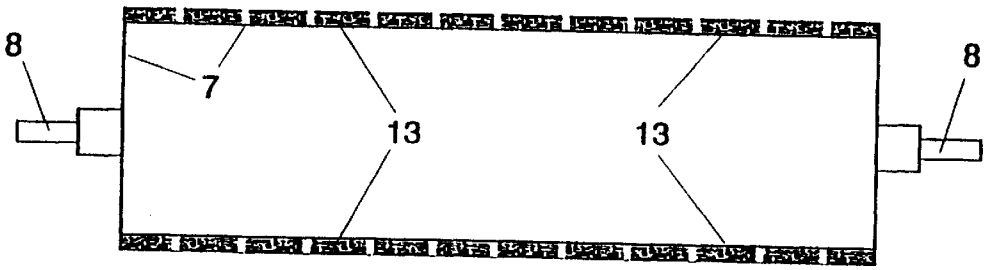
FIG. 6 is a section of a roller wherein the compressible layer consists of individually applied rings.

FIG. 6 shows the preferred embodiment of a support or backing roller of the invention, wherein the compressible layer 9 consists of individual rings 13. The rings 13 having a width of 50 mm to 500 mm in the axial direction of the roller are arranged either in immediate succession or at such a short distance from each other that the gap between two rings 13 cannot produce marks on the winding roll 2. If there is a distance between the rings 13, then it preferably ranges between 5 mm to 30 mm. Preferably rings 13 are used with an inner diameter which is larger then the desired thickness of the layer 9 and somewhat smaller than the outer diameter of the support body 7. One after the other the rings 13 are pushed with a stretched inner diameter over the support body 7 so that afterwards they are lodged on the support body 7 under tension. The tension insures a slip-free fit of the rings 13 on the support body 7. A sufficiently firm fit can also be achieved when the rings 13 are fastened to the support body 7 by positive locking, or through cementing or jamming. The rings 13 are arranged parallel to each other on the support body 7, so that their frontal surfaces run either perpendicularly or obliquely with respect to the roller axis. In the second variant the rings form a quasi-screw thread with the advantage that the gap between the rings 13 permanently varies its position during rotation, this way avoiding marks on an adjacent winding roll.

Another possibility to mount the compressible layer 9 on the support roller 7 consists in winding a compressible strip material onto the support body 7 in the form of a screw thread. The slip-free fit of the layer 9 can be achieved with the aforedescribed techniques, by winding the strip in a prestressed state. The roller consists then of a support body 7 with a compressible layer 9 made of a strip-like material wound in the manner of a screw thread.

Figure 7:
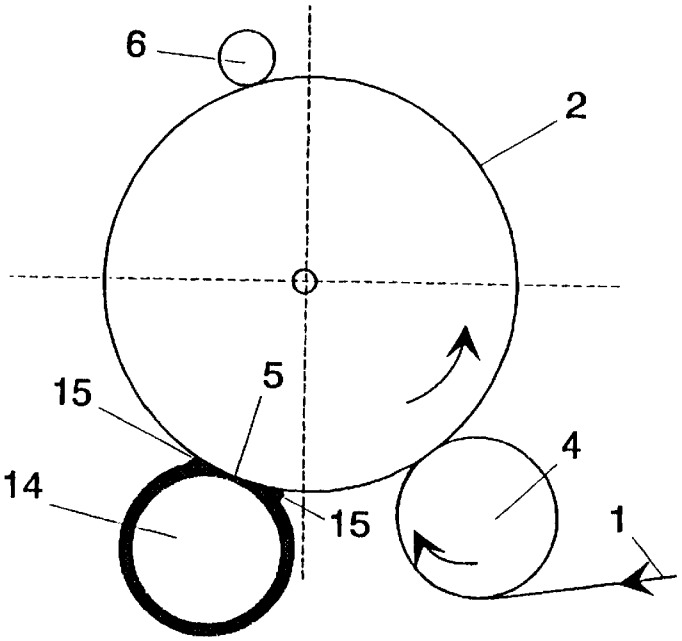

The advantageous influence of a support or backing roller 3 compared to the known support or backing rollers 14 with an elastic but incompressible peripheral surface (e.g. made of solid rubber) is explained in FIGS. 7 and 8.

FIG. 7 shows a winding machine with support rollers according to the state of the art, wherein the support roller 14 on the outgoing side has an elastic but incompressible peripheral surface. Under the weight of the winding roll 2 the support roller 14 is elastically deformed in the nip 5. The yielding elastic material forms on both ends of nip 5 the swellings 15, which protrude radially with respect to the rest of the peripheral surface. The swellings 15 on the nip 5, which evidently influences the winding hardness, increase the effective radius of the support roller 14, so that the outermost layer of the winding roll 2 is accelerated. This acceleration increases the so-called nip-induced stretching of the outer layer, i.e. the winding hardness increases. The positive effect intended by the outer elastic layer, namely to reduce the contact pressure and thereby also the winding hardness depending on the contact pressure through the widening of the nip 5, is decisively diminished and can even be reversed to the contrary.

FIG. 8 represents the conditions during winding with a winding machine with support rollers when a support roller 3 according to the invention is used.

Under the weight of the winding roll 2 the compressible layer 9 is compressed, its volume is reduced. A wider nip 5 with no swellings or with negligibly small swellings at both ends results. The contact pressure on the support roller 3 decreases as a result of the wider nip 5 and the nip-induced stretching of the outermost layer on the winding roll 2 is reduced. Compared to the known winding machines, it is possible to wind with reduced winding hardness at the same contact weight per meter of roller length. This allows for the winding of rolls with a bigger final diameter, without damaging the paper or cardboard web or without producing defects in the wound roll 2.

The use of a roller according to the invention is not limited to use as a support roller in winding machines with support rollers, but it can also be advantageously used in other types of winding machines, as a contact roller pressed against the winding rolls, in order to produce large-diameter and high-quality wound rolls at high production speeds. It is particularly advantageous to use it as a support roller in so-called support-roller winding machines wherein on both sides of a central support roller winding stations are arranged in two winding lines and which are alternately fed with the individual webs. Each winding roll—as for instance described in German Patent 36 29 024—is held by two guide heads supported on winding brackets of the winding station, which take up a part of the weight of the winding rolls. The remaining part is taken up by the central support roller on which the winding roll is supported.

When used as a pressure roller, which is marked with the reference numeral 6 in FIGS. 7 and 8, in the case of small axial length the roller is built as previously described in FIGS. 1 to 6. Since pressure rollers are supported freely rotatable and are not driven, no rotary drive engages at the pivot 8. In pressure rollers with large axial length, such as used for instance in support-rollers winding machines, the pressure roller is preferably made of segments which are individually rotatably supported, in order to make possible an independent rotation of each segment. Pressure rollers have diameters ranging between 200 to 400 mm, i.e. normally smaller diameters than the support or backing rollers.

We claim:

1. A roller for a winding machine for winding paper or cardboard webs into rolls, said roller comprising:

a hollow cylindrical support body made of a rigid material; and a deformable layer on said body and consisting of cellular plastic material with a multitude of uniformly distributed pores and of a compression modulus k of less than 10 MPa, said pores being partially open pores and partially pores closed off on themselves.

2. The roller defined in claim 1 wherein the layer consists of a cellular elastomer particularly polyurethane, with a compression modulus between 1 MPa and 5 MPa.

3. The roller defined in claim 2 wherein the layer consists of polyurethane.

4. The roller defined in claim 1 wherein the size of the pores is less than 5 mm.

5. The roller defined in claim 4 wherein the size of the pores is between 0.05 mm and 1 mm.

6. The roller defined in claim 1 wherein the proportion of open pores is 30% to 70%.

7. The roller defined in claim 6 wherein the proportion of open pores is about 50%.

8. The roller defined in claim 6 wherein the layer has a hardness of between 15 and 60 Shore A.

9. The roller defined in claim 6 wherein the thickness of the layer is at least 10 mm.

10. The roller defined in claim 9 wherein the thickness of the layer is between 10 mm and 40 mm.

11. The roller defined in claim 9 wherein a wear-resistant elastic running layer is applied to an outside of the deformable layer.

12. The roller defined in claim 11 wherein the elastic running layer has grooves.

13. The roller defined in claim 1 wherein between the deformable layer and the support body is arranged a hard base layer which consists of an incompressible material and which is connected to the support body in a non-slip manner.

14. The roller defined in claim 1 wherein the deformable layer is composed of individual rings.

15. The roller defined in claim 14 wherein the rings are arranged at a distance of 5 mm to 50 mm from one another.

16. The roller defined in claim 14 wherein end faces of the rings run obliquely to a roller axis.

17. The roller defined in claim 1 wherein the deformable layer consists of a helically applied tape-like material.

18. A winding machine for winding paper or cardboard webs into rolls, comprising at least one supporting or pressing roller, said roller comprising:

a hollow cylindrical support body made of a rigid material; and a deformable layer on said body and consisting of cellular plastic material with a multitude of uniformly distributed pores and of a compression modulus k of less than 10 MPa, said pores being partially open pores and partially pores closed off on themselves.

19. The winding machine according to claim 18 with two supporting rollers carrying the weight of the winding roll, with one of the two carrying rollers being arranged in such a way that a line of contact with the rolls is lower than the line of contact of the other supporting roller, at least the supporting roller with the lower line of contact having said layer.

* * * * *